US005924769A

United States Patent [19]

Kao

[11] Patent Number: 5,924,769

[45] Date of Patent: Jul. 20, 1999

[54] ARMREST UNIT HAVING A TOP PLATE WITH WOOD GRAIN PATTERNS

[76] Inventor: Hsin-Lin Kao, No. 161-6, Community 20, Lu Chu Ts'un, Lu Chu Hsiang, Taoyuan Hsien, Taiwan

[21] Appl. No.: 09/093,405

[22] Filed: Jun. 9, 1998

[51] Int. Cl.[6] ..... A47C 5/04

[52] U.S. Cl. ..... 297/411.44; 297/411.2; 297/452.38

[58] Field of Search ..... 297/411.44, 411.46, 297/411.2, 463.1, 463.2, 283.1, 452.38; 24/289, 292, 297

[56] References Cited

U.S. PATENT DOCUMENTS

| | | | |
|---|---|---|---|
| 2,292,445 | 8/1942 | Hilldring | 297/411.2 X |
| 2,894,426 | 7/1959 | Rapata | 24/297 X |
| 3,137,527 | 6/1964 | Hoven et al. | 297/452.38 X |
| 3,446,530 | 5/1969 | Rowland | 297/411.2 X |
| 4,186,964 | 2/1980 | Marrujo et al. | 297/411.2 X |
| 4,331,360 | 5/1982 | Roudybush et al. | 297/411.2 X |
| 5,395,161 | 3/1995 | Spykerman et al. | 297/452.38 X |

FOREIGN PATENT DOCUMENTS

| | | | |
|---|---|---|---|
| 1003115 | 11/1981 | WIPO | 297/452.38 |

*Primary Examiner*—Laurie K. Cranmer
*Attorney, Agent, or Firm*—Rosenberg, Klein & Bilker

[57] ABSTRACT

An armrest unit having a top plate with wood grain patterns including a plastic injection molded armrest and a decorative top plate. The armrest has an upper surface provided with a peripheral depression and an array of spaced coupling holes, each of which has a positioning hole of a larger diameter at a bottom end. The decorative top plate is sized and shaped to match the upper surface of the armrest and has an inverted U-shaped cross section. The decorative top plate is further provided with a plurality of spaced retaining elements for engaging the coupling holes of the upper surface of the armrest such that the decorative top plate can be firmly and integrally fitted onto the upper surface of the armrest to enhance the appearance of the armrest.

5 Claims, 7 Drawing Sheets

ARMREST UNIT HAVING A TOP PLATE WITH WOOD GRAIN PATTERNS

BACKGROUND OF THE INVENTION (a) Field of the Invention

The present invention relates generally to an armrest unit, and more particularly to an armrest unit having a decorative top plate with patterns simulating grains of wood so as to enhance the appearance and texture of the armrest.

(b) Description of the Prior Art

Office chairs generally have the chair structure as shown in FIG. 1 due to consideration of space and convenience. The chair C may or may not be provided with armrests A. The armrests A are injection molded from plastics and then locked to both sides of the chair C. Plastic injection molded armrests are widely used and competitive in the marketplace because they can be mass produced and inexpensive to manufacture as compared to metal and wooden armrests. However, plastic armrests are not so appealing in texture as wood armrests. Use of chairs with wooden armrests for offices will be very uneconomical because wood especially mahogany is very expensive. Besides, the strength of wooden armrests is not as good as that of plastic injection molded armrests.

Although some manufacturers have attempted to mold plastic armrests having natural wood grains to enhance their appearance and texture, since armrests have curvatures, it is very difficult to form wood grain patterns on the armrests during injection molding. As for use of transfer printing or other techniques to form wood grain patterns on the armrests, there are also difficulties or the quality of the resultant products are not satisfactory.

SUMMARY OF THE INVENTION

A primary object of the present invention is to provide an armrest unit having a top plate with wood grain patterns such that an upper surface of the armrest has grains simulating those of wood to enhance the appearance and texture of the armrest.

Another object of the present invention is to provide an armrest unit having a top plate with wood grain patterns in which a decorative top plate having wood grain patterns is convenient to fit onto an armrest and may stay secured on the armrest after assembly.

A further object of the present invention is to provide an armrest unit having a top plate with wood grain patterns which can match other office furniture items.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
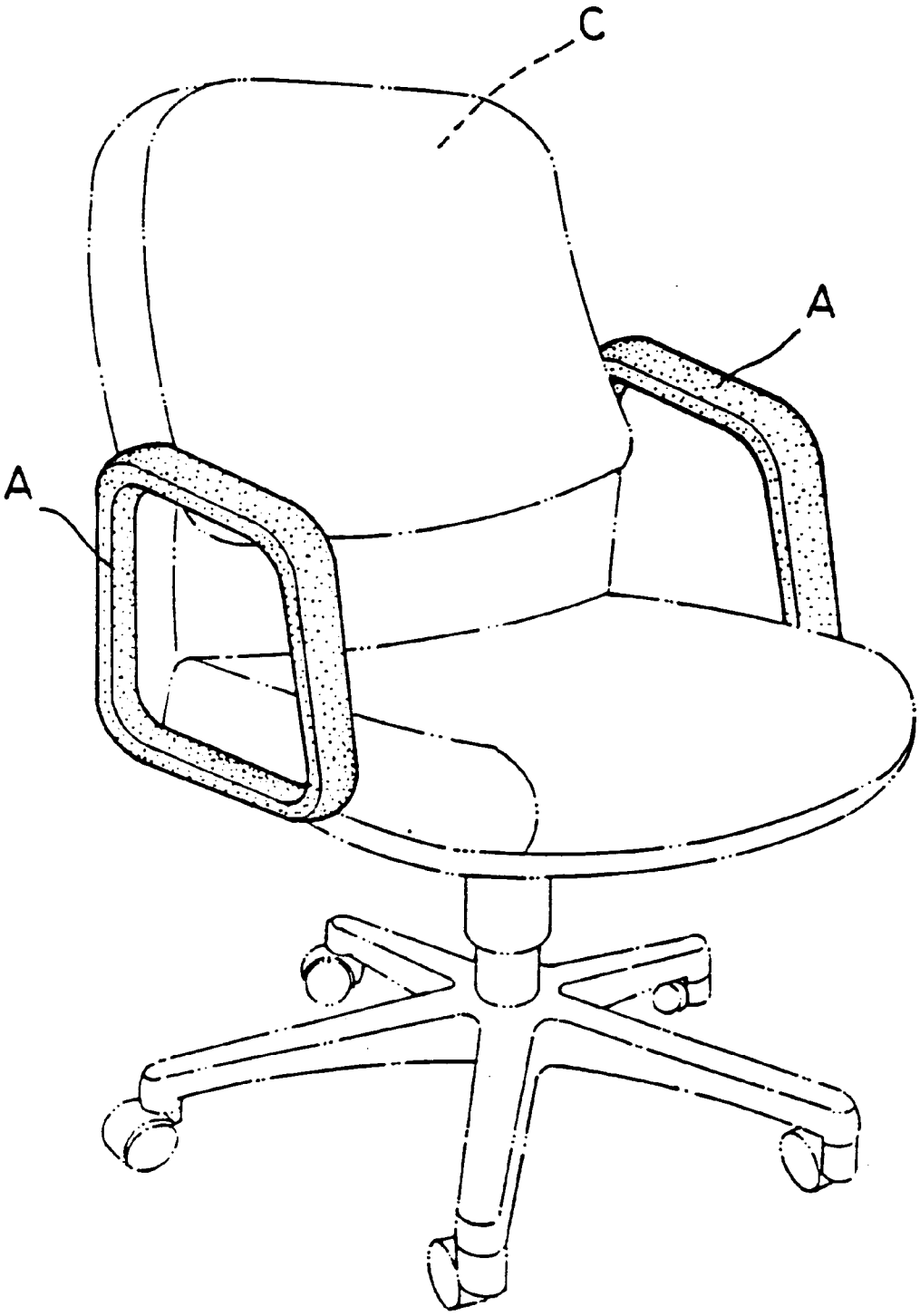
FIG. 1 PRIOR ART
FIG. 1 is a schematic view of the prior art.

With reference to FIGS. 2–6, a preferred embodiment of the armrest of a chair according to the present invention is shown to comprise an armrest 1 and a decorative top plate 2 having wood grains.

The armrest 1 is formed by plastic injection molding, the armrest 1 including an upper surface 11 provided with a depression 12 running along the periphery of the upper surface 11 and a plurality of spaced coupling holes 13 arranged in a row, the coupling holes 13 each having a positioning hole (eye) at a bottom portion thereof and having a larger internal diameter.

Figure 5:
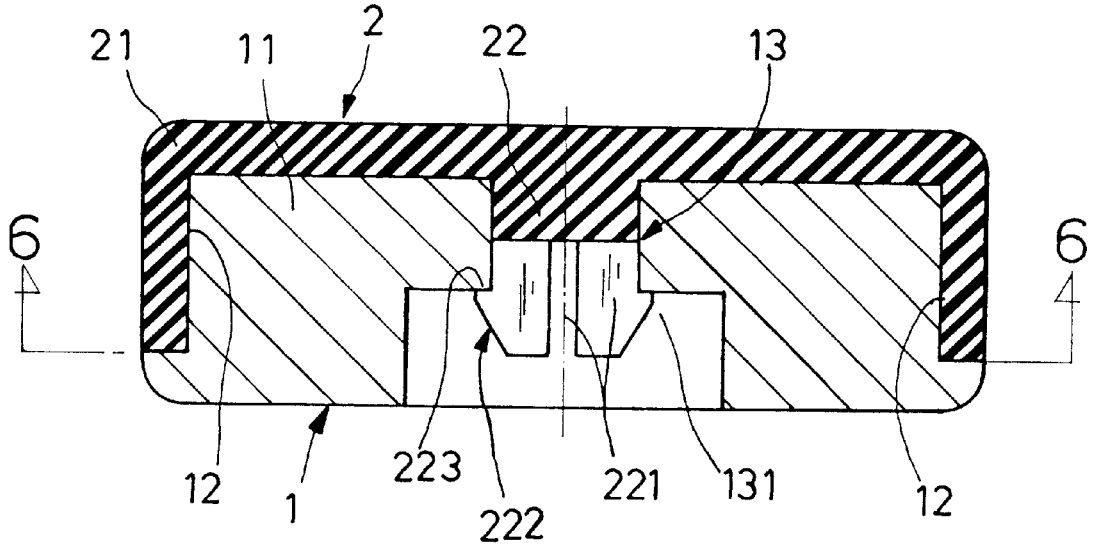
FIG. 5 is a schematic cross-sectional view taken along line 5—5 of FIG. 4, showing the positioning of retaining elements according to the present invention.
Figure 6:
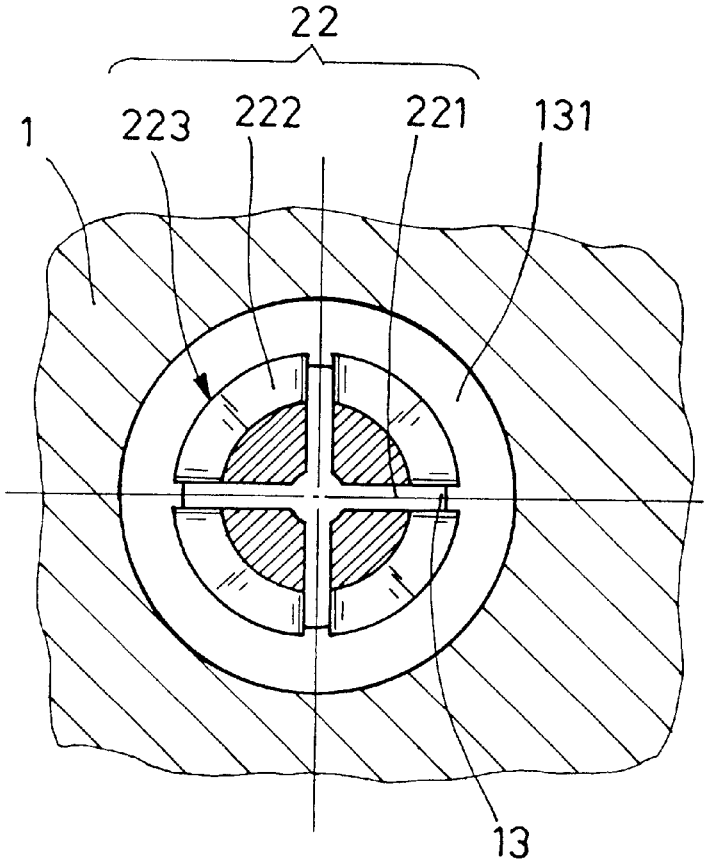
FIG. 6 is a schematic cross-sectional view taken along line 6—6 of FIG. 5.

The decorative top plate 2 is shaped and sized to match the upper surface 11 of the armrest 1 and has a substantially inverted U-shaped cross section 21. A plurality of retaining elements 22 are provided on a lower surface of the decorative plate 2 to correspond to and engage the coupling holes 13 of the upper surface 11 of the armrest 1. Each retaining element 22 is provided with more than one slit 221 at a lower end thereof, as shown in FIGS. 5 and 6. Preferably, a cross-shaped slit 221 is provided. Furthermore, the retaining element 22 is configured to have an inverted conical portion 222 at a bottom end thereof, a base portion of the inverted conical portion 222 being enlarged to form a flange 223 such that, when the retaining elements 22 are respectively fitted into the coupling holes 13, the flanges 223 will hook the interior of the coupling holes 131 to firmly secure the decorative top plate 2 on the upper surface 11 of the armrest 1 as an integral whole.

The decorative top plate 2 may be made from wooden material or plastic processed to have wood grains. Certainly, the decorative top plate 2 will have a much better texture if it is made of wood. As only the decorative top plate 2 is made of wood, compared to conventional wooden armrests which are entirely made of wood, the armrest 1 of the present invention is much lighter and less inexpensive to manufacture, yet having an appearance not much inferior to wooden armrests and better strength than armrests entirely made from plastics.

In addition, as mentioned in the background, it is difficult to directly process the upper surface of plastic armrests to simulate wood grains, it is much easier to process a plastic plate like the decorative top plate 2 of the present invention. The technique of processing plastic surfaces to simulate wood grains is well known, such as the decorative wood-simulating panels used in automobiles. Therefore, a plastic plate may be directly surface-processed to have grains resembling those of wood to constitute the decorative top plate 2 of the present invention. As it is configured to have an inverted U-shaped cross section, the decorative top plate 2 may be fitted onto the upper surface 11 of the armrest 1 directly with the retaining elements 22 thereof engaging the coupling holes 13 of the upper surface 11 of the armrest 1 to secure the decorative top plate 2 integrally on the armrest 1.

Figure 2:
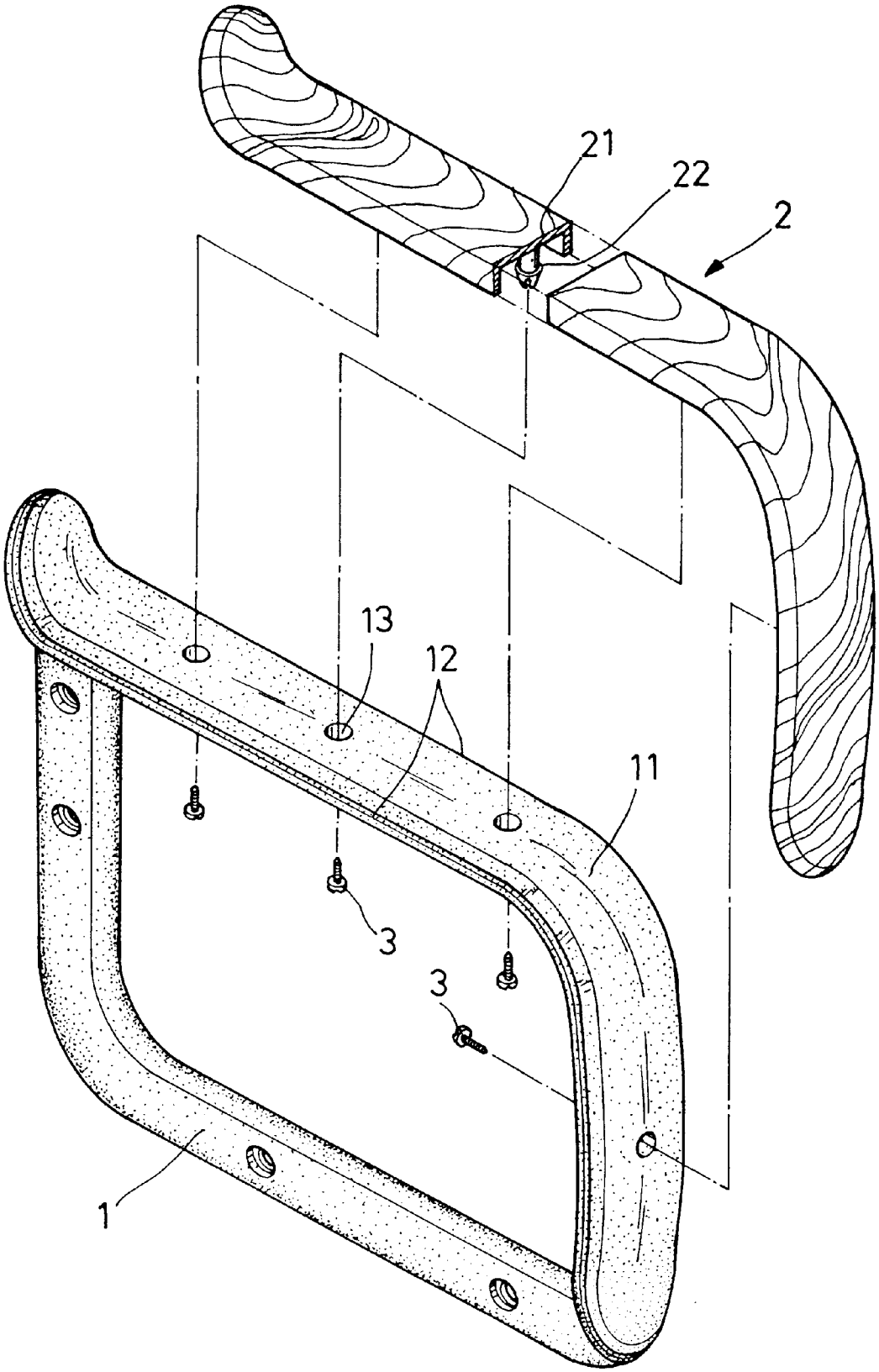
FIG. 2 is a perspective exploded view of a preferred embodiment of the present invention.
Figure 3:
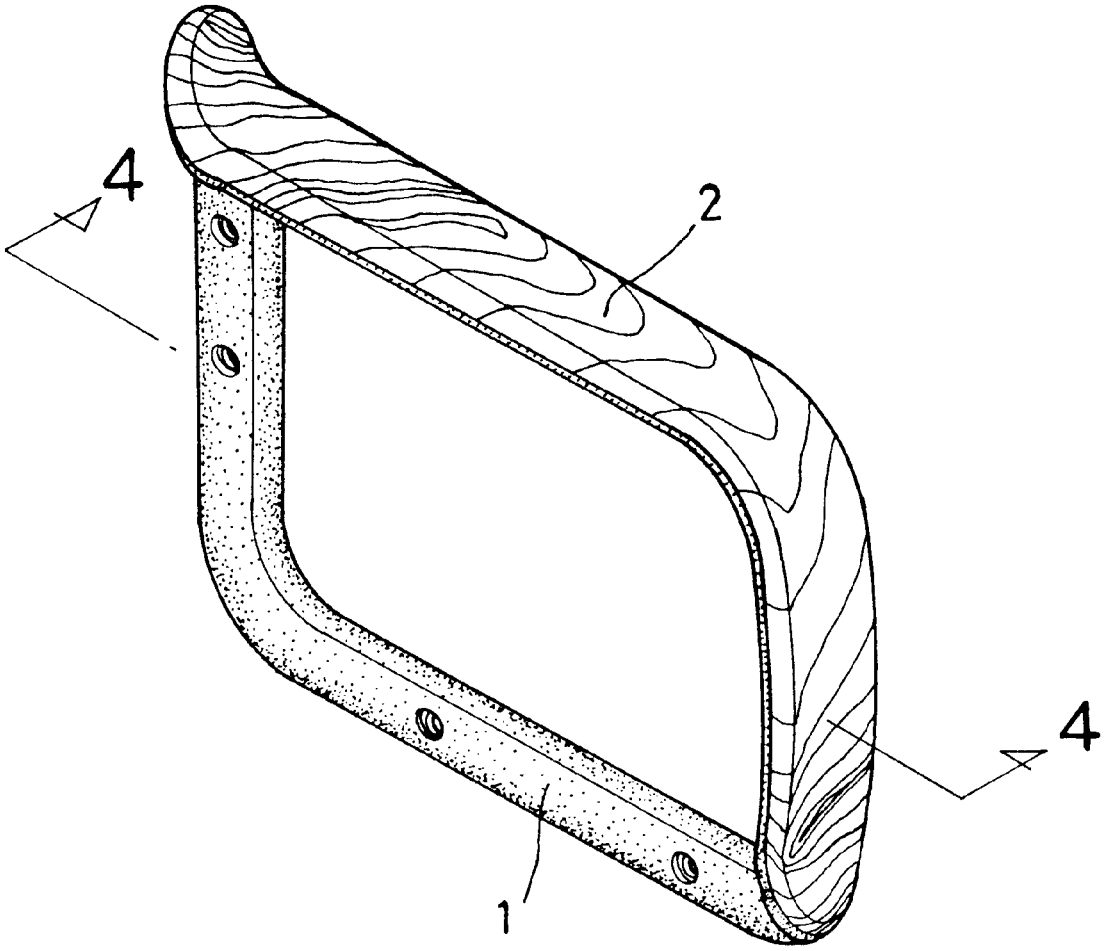
FIG. 3 is a perspective assembled view of the preferred embodiment of the present invention.
Figure 4:
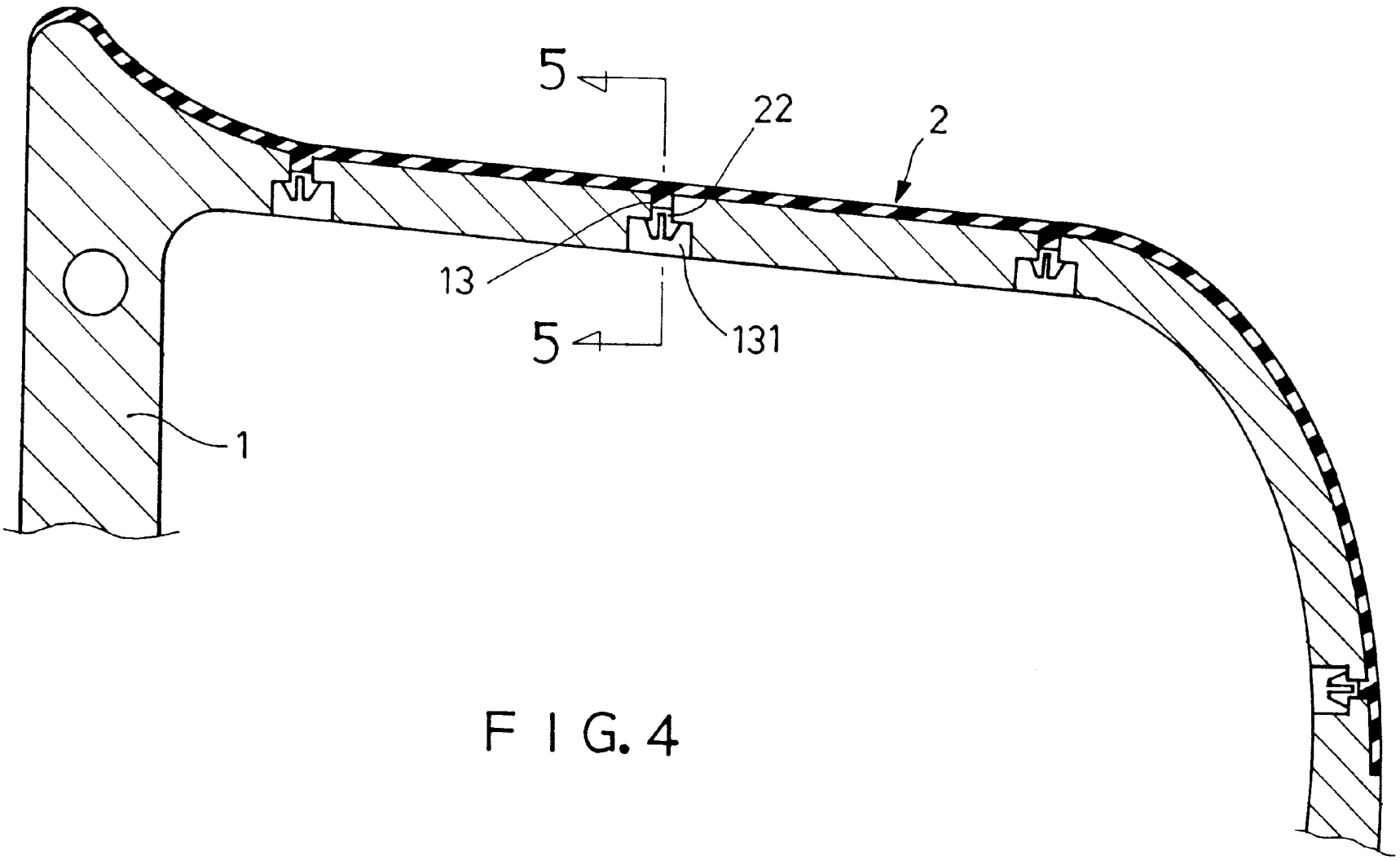
FIG. 4 is a schematic cross-sectional view taken along line 4—4 of FIG. 3.

Assembly of the present invention is illustrated in FIGS. 2, 5 and 6. As the decorative top plate 2 has a certain flexibility whether it is made from wood or plastics, it is only necessary to align it with the upper surface 11 of the armrest 1 and cause the retaining elements 22 to fit into the corresponding coupling holes 13. When the retaining elements 22 are being fitted into the corresponding coupling holes 13, due to the slit or slits 221 formed at the lower end of each retaining element 22, the respective inverted conical portions 222 may be squeezed into the coupling holes 13. After passage, the inverted conical portions 222 will resume its original shape with the flanges 223 engaging the bottom edges of the respective positioning holes 131 to enable the decorative top plate 2 and the armrest 1 to couple as an integral whole. As the decorative top plate 2 has the inverted U-shaped cross section 21, it can perfectly fit onto the upper surface 11 of the armrest 1 with the rims thereof engaging the depression 12 along the periphery of the upper surface 11 of the armrest 1 to facilitate coupling thereof to the armrest 1 as an integral whole. Besides, the edges of the decorative top plate 2 will flush perfectly with the upper surface 11 to achieve an appealing appearance.

Figure 7:
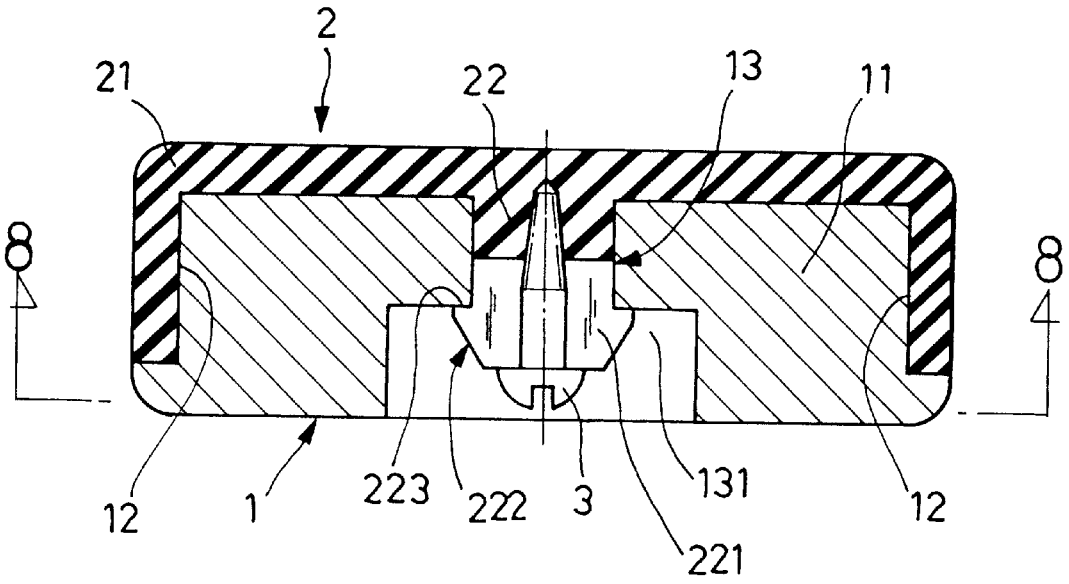
FIG. 7 is a sectional view of the present invention showing use of screws to secure a decorative top plate on the armrest of the present invention.
Figure 8:
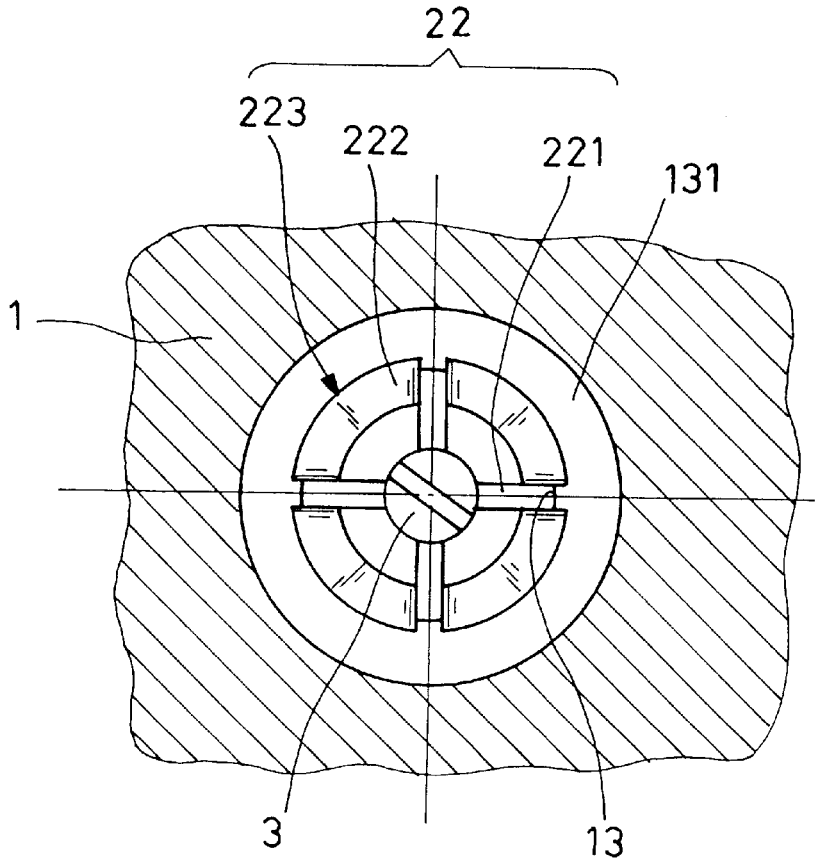
FIG. 8 is a schematic cross-sectional view taken along line 8—8 of FIG. 7.

Furthermore, with reference to FIGS. 2, 7 and 8, in order to prevent the decorative top plate 2 from slipping from the armrest 1 due accidentally subjected to an external impact or large force, a screw 3 may be driven into the center of the slit or slits 221 at the bottom of each retaining element 22 from the lower side of each coupling hole 13 so that the inverted conical portion 222 will be compelled to remain extended to cling to the bottom edge of the positioning hole 131 to prevent the decorative top plate 2 from falling off.

Figure 9:
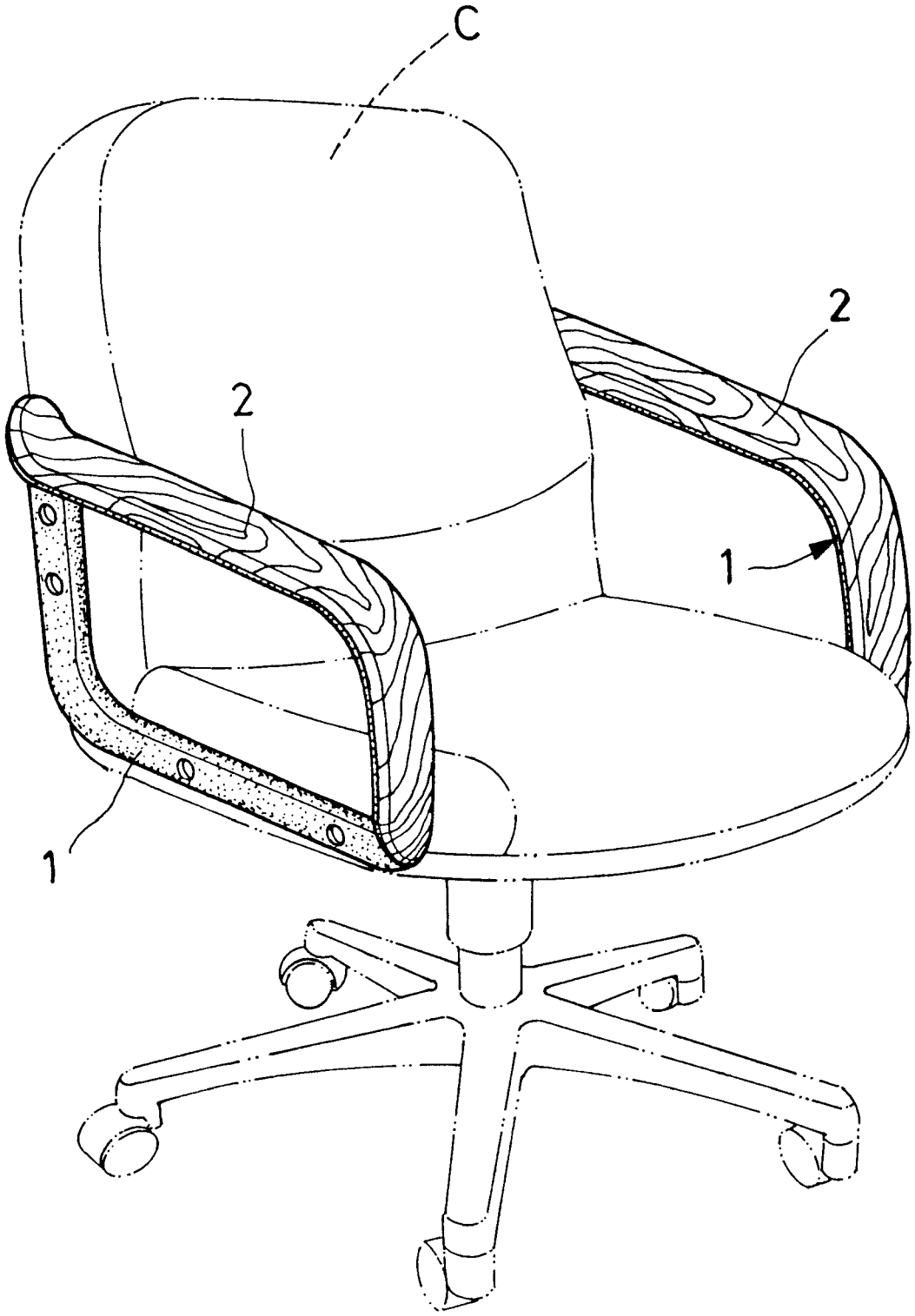
FIG. 9 illustrates the present invention in use.

FIG. 9 illustrates the present invention in use. As shown, the armrest 1 of the present invention has a more appealing look than conventional plastic ones and can better match the texture of the seat C. The armrest 1 of the present invention has not only the strength of plastics but also the texture of wood surfaces so that the chair incorporating armrests according to the present invention can match other wooden furniture items.

Although the present invention has been illustrated and described with reference to the preferred embodiment thereof, it should be understood that it is in no way limited to the details of such embodiment but is capable of numerous modifications within the scope of the appended claims.

What is claimed is:

1. An arm support assembly comprising:

(a) an armrest including a longitudinally extended support section having top and bottom surfaces on opposing sides thereof, said top surface having formed therein a plurality of coupling holes spaced one from the other substantially in longitudinally aligned manner, said support section having a flanged portion peripherally bounding at least a portion of said top surface, said bottom surface having formed therein at least one recess communicating with at least one of said coupling holes;

(b) at least one decorative top plate coupled to said armrest, said top plate being configured to substantially envelop said top surface and engage said flanged portion of said armrest support section, said top plate having a plurality of spaced axially-extended retaining elements projecting therefrom for mated coupling, respectively, to said coupling holes of said top surface, each said retaining element having an axial bore formed therein and terminating at an inverted conical portion for locking said coupling of said retaining element to one of said coupling holes, said inverted conical portion having a plurality of flanged engagement segments resiliently biased to engage said recess communicating with said one of said coupling holes, said engagement segments being separated one from the other by at least one transversally extending slit.

2. The arm support assembly as recited in claim 1 further comprising at least one screw matingly coupled to said axial bore of one said top plate retaining element for maintaining said flanged engagement segments thereof in engagement with said recess.

3. The arm support assembly as recited in claim 2 wherein said armrest is formed of an injection molded plastic composition.

4. The arm support assembly as recited in claim 3 wherein said top plate is characterized by a substantially U-shaped cross-sectional contour.

5. The arm support assembly as recited in claim 4 wherein said top plate has formed thereon wood grain-simulating indicia.

* * * * *